United States Patent [19]

Zingg

[11] 4,007,921

[45] Feb. 15, 1977

[54] APPARATUS FOR MIXING DRY PARTICLES WITH A LIQUID

[75] Inventor: Warren M. Zingg, Tulsa, Okla.

[73] Assignee: The Dow Chemical Company, Midland, Mich.

[22] Filed: Jan. 19, 1976

[21] Appl. No.: 650,091

[52] U.S. Cl. ..... 259/151; 259/4 R; 259/60; 259/95; 259/161

[51] Int. Cl.[2] ..... B28C 5/06; B01F 13/10

[58] Field of Search ..... 259/4 R, 18, 36, 60, 259/95, 145, 147, 151, 161, 164, 165, 169, 170, 163

[56] References Cited

UNITED STATES PATENTS

| | | | |
|---|---|---|---|
| 2,900,176 | 8/1959 | Krogel | 259/95 |
| 3,201,093 | 8/1965 | Smith | 259/4 R |
| 3,542,342 | 11/1970 | Barron | 259/4 R |
| 3,563,517 | 2/1971 | Harriman | 259/4 R X |
| 3,741,533 | 6/1973 | Winn | 259/4 R |

FOREIGN PATENTS OR APPLICATIONS

| | | | |
|---|---|---|---|
| 1,940,458 | 5/1970 | Germany | 259/95 |

*Primary Examiner*—Philip R. Coe
*Attorney, Agent, or Firm*—V. Dean Clausen

[57] ABSTRACT

A blender apparatus is disclosed which is useful for mixing dry particles with a liquid. In a specific application, dry cement is mixed with water to obtain a cement slurry for cementing oil and gas well casings. The cement particles and water are directed into a disperser unit, in which the water contacts the cement particles at an acute angle. The resulting slurry is passed into a volute casing positioned in a tank. As the slurry swirls within the volute, it develops a vortex action, which continuously circulates the mixture in the tank. The slurry is pumped from the tank and split into two streams. Part of the slurry stream flows directly to a pumper unit, for injection into the well. The remainder of the stream is pumped through a restricting nozzle and back through the volute, to provide a continuous recycle which enhances blending of the dry material with the liquid.

7 Claims, 2 Drawing Figures

APPARATUS FOR MIXING DRY PARTICLES WITH A LIQUID

BACKGROUND OF THE INVENTION

Broadly, the invention relates to an improved apparatus for mixing dry particles with a liquid. More specifically, the invention is directed to an apparatus which is particularly suitable for mixing dry cement with water to obtain a cement slurry.

There are many chemical processes and other industrial applications which require mixing of dry solids with a liquid to obtain a working fluid or final product. To obtain satisfactory mixing of the solid and the liquid, the mixing device must meet two basic requirements. One requirement is that the device be capable of wetting the solids sufficiently to avoid forming agglomerates of the solid material. Secondly, the device must be able to furnish enough energy to thoroughly mix the solids and the liquid in a desired ratio.

As an example, well casings penetrating a subterranean formation are cemented with a slurry mixture obtained from mixing a dry cement blend with water. One of the conventional systems used to mix the cement slurry is a unit known as a vortex mixer. In one type of vortex mixer the dry cement particles are directed downwardly through a vertical pipe section which opens into a pump volute casing. As the cement drops into the volute casing it is contacted by water, the water being directed downwardly through an outer pipe section which encloses the "cement" pipe and which also opens into the volute casing.

In this mixer the volute casing and the lower end of the concentric pipe sections are supported inside a holding tank. As the slurry mixture leaves the pump volute, therefore, it is contained within the holding tank. From the holding tank, part of the slurry is continuously recycled through a densiometer and a recycling pump and back through the pump volute. At the same time, the remaining part of the slurry is directed from the recycling pump to a cement pumper and into the well bore.

The vortex mixer described above has certain disadvantages which make it unsuitable for mixing a dry solid and a liquid, such as cement and water. The main problem occurs at the outlet of the volute casing. The volute outlet is that point at which the slurry mixture passes from the volute casing into the mixture which is circulating in the holding tank. At the volute outlet the cement blend tends to form a mound of cement particles which stack up and obstruct the outlet.

This situation is caused by the fact that the water in the outer pipe and the cement in the inner pipe are moving along the same downward vector at the point of contact. To explain further, since the cement particles are much lighter than the water, the water is moving at a higher velocity than the cement at the point of contact. With both materials moving in the same directon, therefore, the drag friction between these materials is so low that the water is unable to sufficiently wet the dry particles.

SUMMARY OF THE INVENTION

In the present mixing apparatus, a charge of the dry particles to be mixed with a liquid are stored in a hopper. The hopper includes a discharge outlet which communicates with a first conduit section. The apparatus includes a means for dispersing the particles in the liquid. In general, the disperser is defined by a mixing chamber having a first vertical nozzle in communication with the first conduit section, and a first compartment positioned below the first nozzle.

The mixing chamber includes a second compartment which surrounds and communicates with the first compartment. In addition, the second compartment is connected into a source of liquid. The mixing compartment also includes a vane member which is positioned adjacent to the second compartment and above the first compartment. In addition, the vane member is spaced from the first nozzle, such that the space defines an air inlet passage in communication with air inlet ports in the chamber.

The mixing apparatus further includes a tank container with a vent opening therein. A volute casing is positioned in the tank container and a second conduit section connects the volute casing with the first compartment of the disperser. A third conduit section connects the tank container with a fourth conduit section. In turn, the fourth conduit section is connected into the second conduit section and into a use point. A pump means is installed in the third conduit section and a second nozzle is positioned horizontally within the fourth conduit section.

In a typical operation, the dry particles are passed from the hopper into the first compartment of the disperser through the first nozzle. At the same time, liquid received in the second compartment is passed into the first compartment. In the first compartment the liquid mixes with the dry particles to produce a slurry mixture, and the mixture is delivered into the volute casing. The slurry mixture thus circulates within the volute casing and within the tank container. Part of the slurry mixture in the tank container is then continuously circulated back into the tank container through the pump and the second nozzle. At the same time, the remaining part of the slurry is delivered to the use point.

DESCRIPTION OF A PREFERRED EMBODIMENT

Figure 1:
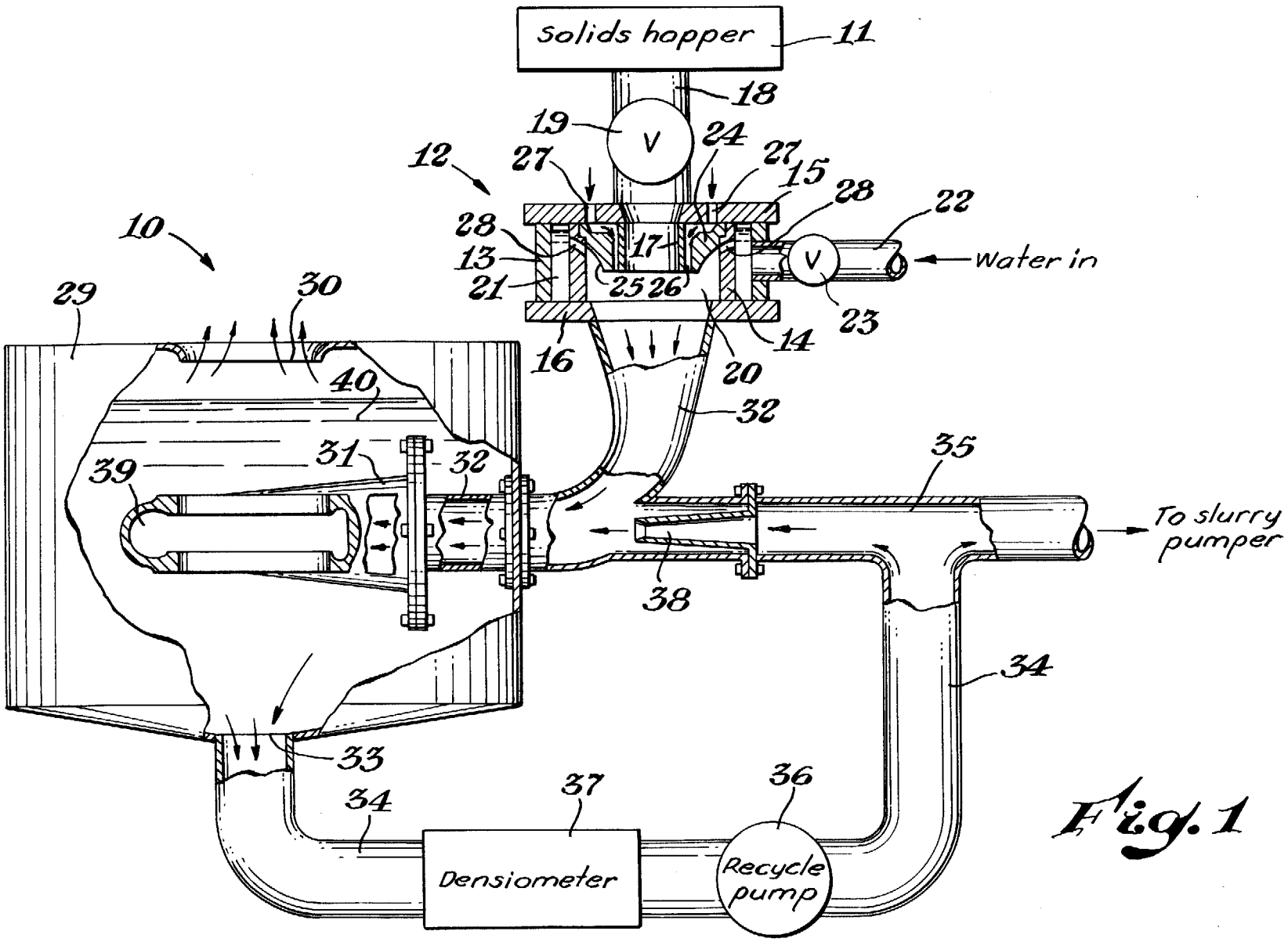
FIG. 1 is a side elevation view, partly schematic and partly in section, of one embodiment of a mixing apparatus according to this invention.
Figure 2:
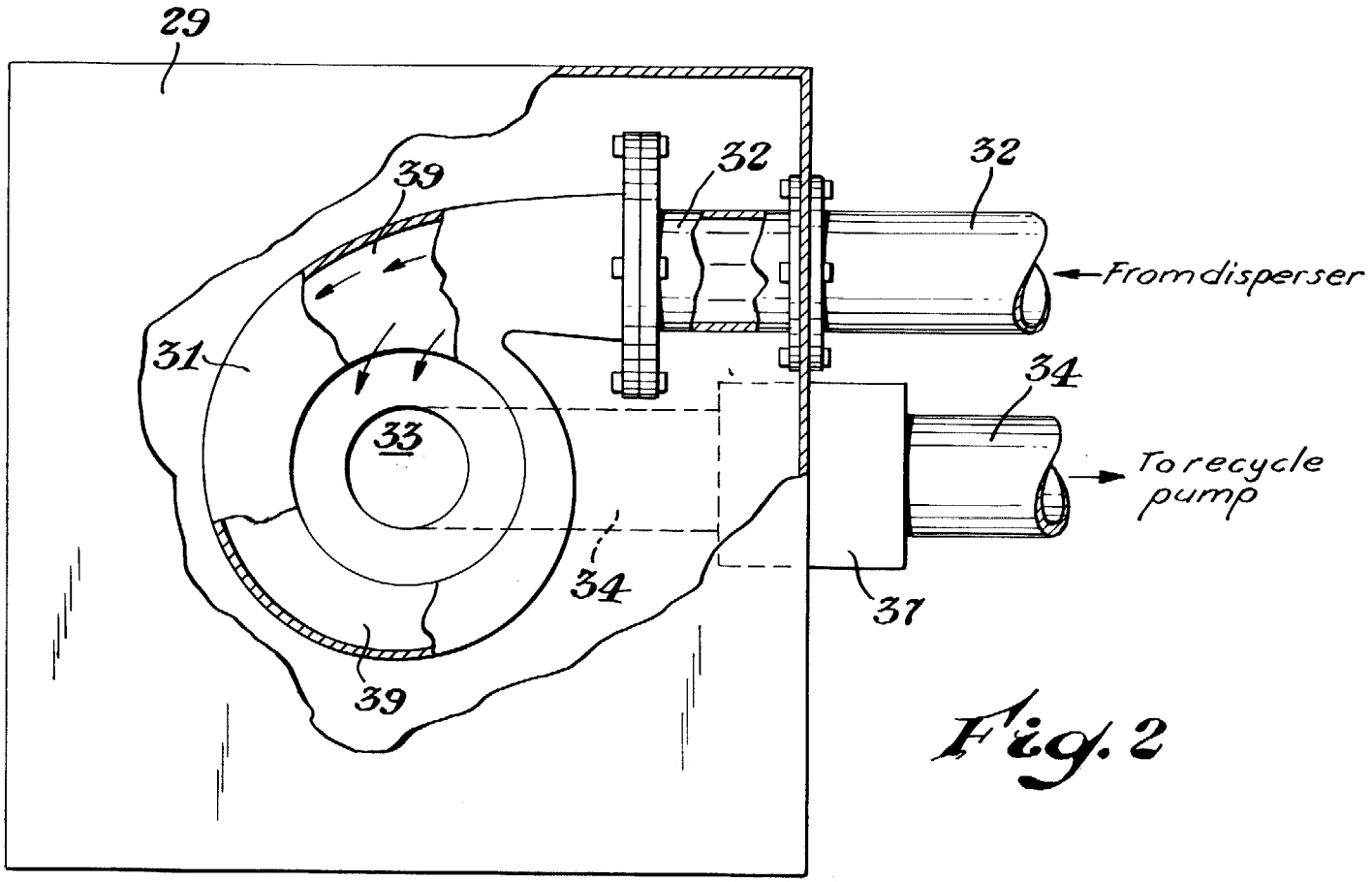
FIG. 2 is a plan view, partly in section, of the tank container and the volute casing components which form a part of the apparatus of FIG. 1.

Referring to the drawing, and particularly to FIG. 1, the numeral 10 indicates generally a mixer apparatus according to this invention. Means for storing a charge of dry particles to be mixed with a liquid is provided by a hopper 11. The hopper 11 is connected into a disperser, as generally indicated by numeral 12. The basic structure of disperser 12 is a main chamber. Specifically, the chamber is defined by an outer upstanding wall 13, an inner upstanding wall 14, a top wall 15, and a bottom wall 16.

The hopper 11 is connected into an inlet nozzle 17 of disperser 12 by a conduit section 18. A regulating valve 19 is installed in conduit section 18. In disperser 12 the space enclosed by inner wall 14 provides a mixing compartment 20. A second compartment 21, which surrounds the mixing compartment 20, is defined by the space between inner wall 14 and outer wall 13. The liquid shown in compartment 21 is introduced through a conduit section 22, which connects into a source of liquid (not shown). Means for regulating liquid flow into compartment 21 is provided by a valve 23 in conduit 22.

Another component of the disperser 12 is a vane member 24. Basically, vane 24 is a member having a central vertical bore of a circular shape (not numbered) and an outer surface 25, which defines a hexagon shape. In addition, the surface 25 slopes inwardly and downwardly at an angle of about 15° from the vertical. The central bore of vane 24 is spaced slightly from the nozzle 17, and this space provides an air intake passage 26. The passage 26 is in communication with air inlet ports 27 in the top wall 15 of disperser 12.

Each of the six segments which make up the hexagon shape of inner wall 14 has a circular opening therein. Two of these openings are indicated by the numeral 28 in FIG. 1. Each of the openings 28 communicates with a corresponding segment of the hexagon shaped outer surface 25 of vane 24. The purpose of the openings 28 is to permit the liquid in compartment 21, which is received through conduit 22, to flow into compartment 20. Another component of the present mixer apparatus is a holding tank 29, which includes a vent opening 30 in the top of the tank.

Positioned inside tank 29 is a volute casing 31. In the practice of this invention, the casing 31 can be any of the structures generally used in commercially available volute-type pumps. Volute casing 31 communicates with mixing compartment 20 of disperser 12 through a conduit section 32. As indicated in FIG. 1 of the drawing, the conduit section 32 consists of two segments. The upper segment of conduit 32 connects the disperser 12 to tank 29. A lower segment of conduit 32 fastens the volute casing 31 to tank 29, and it also connects casing 31 into the upper conduit segment.

At the bottom of tank 29 is an outlet 33. Outlet 33 is connected into one end of a third conduit section 34. The opposite end of conduit section 34 is connected into a fourth conduit section 35. The junction of conduit section 34 to conduit section 35 forms a tee connection. Conduit section 34 forms the branch of the tee, and conduit section 35 is the run of the tee. One end of conduit section 35 is connected directly into the upper segment of section 32 at a point just outside of tank 29. The opposite end of conduit section 35 connects into a slurry pumper, such as a cement slurry pumper (not shown).

A pump unit 36, such as a centrifugal pump, is installed in conduit section 34. Pump 36 provides means for recirculating the slurry mixture in tank 29. This recirculating step is explained in more detail later in this text. The conduit section 34 may also include a densiometer unit 37, which provides means for determining the density of the slurry mixture. For example, when the present apparatus is used to mix cement slurries for cementing oil wells and gas wells, the density of the slurry is continuously monitored prior to injection into the well.

An orifice nozzle 38 is installed inside conduit section 35 near the point at which conduit section 35 joins the conduit section 32. Nozzle 38 provides a restriction in the flow path of the recirculating slurry mixture which enhances mixing of the slurry. This objective is explained in more detail later in this text. A typical nozzle which may be used is the structure described in U.S. Pat. No. 2,322,087.

A typical operation of the apparatus 10 will now be described to illustrate the practice of this invention. In the operation described herein a dry cement blend is mixed with water to obtain a slurry of the type used in cementing pipe casings in oil wells or gas wells. To start the operation, the regulating valve 19 is opened and dry cement particles are forced out of hopper 19 by air pressure. From hopper 19 the cement particles pass through conduit 18, valve 19, and through nozzle 17 into the mixing compartment 20 of disperser 12.

At the same time that the dry cement particles are passing into mixing compartment 20, the valve 23 is opened to allow water to flow into compartment 21 of disperser 12. From compartment 21 the water flows through each of the circular openings 28, such that each circular stream strikes one of the flat, downwardly sloping surfaces 25 of vane 24. Deflection of the circular water stream against the flat surface 25 generates a flat, continuous sheet of water, which is moving at a downward angle of about 15° from the vertical. The sheet of water thus contacts the cement particles in mixing compartment 20 at an acute angle, since the cement particles are moving vertically downwardly from nozzle 17.

In practice, it has been found that the acute strike angle is a significant factor in achieving good wetting of the dry cement particles. This discovery can be explained as follows. At the point of contact in mixing compartment 20, both the cement particles and the water are moving on a downward vector. In this situation, therefore, the dry particles are not directly colliding with the liquid. From previous studies, I have found that where there is a direct collision of the particles with the wetting liquid, the particles will skip or bounce off of the wetting surface.

The slurry mixture formed in mixing compartment 20 then passes through the conduit section 32 and directly into the volute casing 31. Since most slurry mixtures are sticky materials, they have a tendency to stick to surfaces in the mixing apparatus in which they come in contact. The usual result is a build-up of particles on the machine surfaces which will disrupt the normal flow pattern of the material through the mixer.

The construction and operation of the mixing device of this invention alleviates the problem mentioned above. For example, in disperser 12 the dry cement particles which are moving downwardly in nozzle 17 are contacted by the downwardly moving water sheet somewhere below the lower lip formed at the bottom of nozzle 17 and vane 24. In addition, downward movement of the dry particles and the water generates an aspirating action, which pulls outside air into mixing compartment 20 through the air passage 26 and the air inlet ports 27. The aspirating air thus forms a cushion at the lower lip of nozzle 17 and vane 24, which prevents a slurry build-up on these surfaces. Another reason that slurry build-up does not occur on nozzle 17 and vane 24 is the washing action created by the water which flows downwardly over the outer surfaces 25 of the vane member 24.

When the slurry mixture passes into volute casing 31, it develops a vortex action as it swirls around the spiral-shaped race 39 of the casing. The vortex action of the slurry thus forms a cavity in the center of the volute casing which draws the already-formed slurry mixture 40 into the volute casing. The result is a continuous circulation of the slurry mixture within the tank 29 and volute casing 31, which achieves excellent blending of the solids with the liquid.

As the slurry mixture flows through the various components of the mixing apparatus 10, air bubbles are entrained into the mixture. During circulation of the slurry mixture 40 in tank 29 the air bubbles rise to the surface of the slurry and escape into the atmosphere through the vent opening 30. Venting of the air bubbles is a particuarly desirable feature of the present mixer. For example, air bubbles make very poor cement compositions which are not desirable in oil well cementing work.

The recycle pump 36 pulls the slurry mixture through the conduit section 34 and discharges it into the conduit section 35. During flow through conduit section 34 the slurry mixture is monitored by the densiometer unit 37. The densiometer reading enables the operator to adjust the flow of cement and water into disperser 12 to get the density slurry at the proper level required for the cementing job. As the slurry mixture discharges into conduit section 35, the stream splits. Part of the slurry stream flows to the slurry pumper (not shown), and the remainder of the stream flows through nozzle 38 and back into the volute casing 31.

Earlier in this description it was pointed out that a suitable mixing device for solids and liquids must be able to furnish enough energy to achieve a thorough mixing of the ingredients. In the present apparatus the nozzle 38 greatly increases the energy available in the system. This point can be illustrated by comparing the operation of the present mixing device with the operation of a prior vortex mixer, as described earlier.

In the prior vortex mixer the recycle pump operates against an open discharge. This means that the pump is working only against that pressure created by friction developed by contact of the slurry with the conduit during recycle of the slurry back into the holding tank. In the mixer device of this invention, however, the pressure against the recycle pump 36 is much greater because of the restriction created by nozzle 38 in conduit section 35. Since the recycle pump 36 must work against a higher pressure, the velocity of the slurry mixture which passes through nozzle 38 is also much higher than the velocity of the recycle slurry in the prior mixer. The higher velocity of the recycle slurry in the present apparatus, therefore, provides a much higher kinetic energy which enables a more thorough mixing of the slurry in the holding tank.

What is claimed is:

1. An apparatus for mixing dry particles with a liquid which comprises, in combination;

a hopper for storing a change of dry particles, which hopper includes a discharge outlet;

a first conduit section which communicates with the discharge outlet;

a disperser means, the disperser being defined by a main chamber, the chamber including a first vertical nozzle and a first compartment positioned below the first nozzle, the nozzle communicating with the first conduit section and with the first compartment, the chamber further including a second compartment which surrounds the first compartment and which communicates with the first compartment, a source of liquid connected to the second compartment, air inlet ports in said chamber, the chamber further including a vane member which is positioned adjacent to the second compartment and which includes an outer surface in communication with the first compartment, the vane member being spaced from the first nozzle with the space defining an air intake passage which commmunicates with the air inlet ports in the chamber;

the dry particles in the hopper being passed into the first compartment through the first nozzle, liquid received in the second compartment being passed into the first compartment to thereby mix with the particles and produce a slurry mixture;

a tank container which includes a vent opening therein;

a volute casing which is positioned in the tank container;

a second conduit section which connects the first compartment of the disperser with the volute casing;

the slurry mixture being delivered into the volute casing through the second conduit section, and circulated within the volute casing and within the tank container;

a third conduit section which connects the tank container with a fourth conduit section;

a pump means which is installed in the third conduit section;

the fourth conduit section being connected into the second conduit section and into a use point;

a second nozzle which is positioned within the fourth conduit section; wherein a portion of the slurry mixture is continuously circulated from the tank container through the pump means and second nozzle, and a portion of the slurry mixture is continuously delivered to the use point.

2. The apparatus of claim 1 in which the main chamber is defined by an outer upstanding wall, an inner upstanding wall, a top wall, and a bottom wall.

3. The apparatus of claim 1 in which the vane member is a member having a central vertical bore which is spaced from the first vertical nozzle member and an outer surface of a hexagonal configuration which slopes inwardly and downwardly at an angle of about 15 degrees, and in which the second compartment has spaced openings therein which communicate with the outer surface of the vane member.

4. The apparatus of claim 1 in which a densiometer is installed in the third conduit section ahead of the pump means.

5. An apparatus for mixing a cement slurry, which comprises, in combination;

a hopper for storing a change of dry cement particles, which hopper includes a discharge outlet;

a first conduit section which communicates with the discharge outlet;

a disperser means, the disperser being defined by a main chamber, the chamber including a first vertical nozzle and a first compartment positioned below the first nozzle, the nozzle communicating with the first conduit section and with the first compartment, the chamber further including a second compartment which surrounds the first compartment and which communicates with the first compartment a source of liquid connected to the second compartment, air inlet ports in said chamber, the chamber further including a vane member which is positioned adjacent to the second compartment, the vane member having a central vertical bore which is spaced from the first nozzle and an outer surface which slopes inwardly and downwardly at an angle of about 15 degrees, the space between the central bore of the vane member and the first nozzle defining an air intake passage which communicates with the air inlet ports in the chamber, and the second compartment having spaced openings therein which communicate with the outer surface of the vane member;

the dry particles in the hopper being passed into the first compartment through the first nozzle, liquid received in the second compartment being passed into the first compartment to thereby mix with the particles and produce a cement slurry mixture;

a tank container which includes a vent opening therein;

a volute casing which is positioned in the tank container;

a second conduit section which connects the first compartment of the disperser with the volute casing;

the cement slurry mixture being delivered into the volute casing through the second conduit section, and circulated within the volute casing and within the tank container;

a third conduit section which connects the tank container with a fourth conduit section;

a pump means which is installed in the third conduit section;

the fourth conduit section being connected into the second conduit section and into a use point;

a second nozzle which is positioned within the fourth conduit section; wherein a portion of the cement slurry mixture is continuously circulated from the tank container through the pump means and the second nozzle, and a portion of the slurry mixture is continuously delivered to the use point.

6. The apparatus of claim 5 in which the main chamber is defined by an outer upstanding wall, an inner upstanding wall, a top wall, and a bottom wall, and in which the outer surface of the vane member has a hexagonal configuration.

7. The apparatus of claim 5 in which a densiometer is installed in the third conduit section ahead of the pump means.

* * * * *